US005924218A

United States Patent [19]

Dalvy et al.

[11] Patent Number: 5,924,218

[45] **Date of Patent: *Jul. 20, 1999**

[54] INTERNAL LINER FOR A BOOT

[75] Inventors: Olivier Dalvy, Atneey-Le-Vleux; Jean-Pierre Clement, Persac, both of France

[73] Assignee: Salomon S. A., Metz-Tessy, France

[ * ] Notice: This patent is subject to a terminal disclaimer.

[21] Appl. No.: 08/817,882

[22] PCT Filed: Nov. 8, 1995

[86] PCT No.: PCT/FR95/01476

§ 371 Date: May 1, 1997

§ 102(e) Date: May 1, 1997

[87] PCT Pub. No.: WO96/14769

PCT Pub. Date: May 23, 1996

[30] Foreign Application Priority Data

Nov. 10, 1994 [FR] France ..... 94 13735

[51] Int. Cl.[6] ..... A43B 23/07; A43B 7/14

[52] U.S. Cl. ..... 36/55; 36/93

[58] Field of Search ..... 36/54, 71, 115, 36/93, 117.6, 10

[56] References Cited

U.S. PATENT DOCUMENTS

| | | | |
|---|---|---|---|
| 4,154,009 | 5/1979 | Kubelka et al. | 36/119 |
| 4,433,494 | 2/1984 | Courvoisier et al. | 36/93 X |
| 4,910,889 | 3/1990 | Bonaventure et al. | 36/71 X |
| 5,050,319 | 9/1991 | Perroto et al. | 36/117 |
| 5,203,793 | 4/1993 | Lyden | 36/93 X |

FOREIGN PATENT DOCUMENTS

| | | |
|---|---|---|
| 0004829 | 10/1979 | European Pat. Off. . |
| 0370948 | 5/1990 | European Pat. Off. . |
| 2360271 | 3/1978 | France . |
| 2460118 | 1/1981 | France . |
| 2-270519 | 5/1990 | Japan . |
| WO94/09663 | 5/1994 | WIPO . |

*Primary Examiner*—B. Dayoan
*Attorney, Agent, or Firm*—Greenblum & Bernstein, P.L.C.

[57] ABSTRACT

A comfort liner provided with a wedging element made of foam having thermoplastic qualities rendering it capable of being adjusted and/or adapted, after being heated at its thermoforming temperature, to the specific volume of the user's foot. The liner in its entirety is preformed at an initial fitting volume corresponding to a standard of a given size, and its wedging element, constituted of foam formed from at least one thermoplastic material, is thermocompressed and micro-perforated. The micro-perforations confer to the wedging element a certain flexibility and elastic compressibility, as well as a certain permeability rendering it sufficiently comfortable to be used as such, and adapted to be easily thermoformed by reheating, due to the rapid and in-depth diffusion of the heat across the micro-perforations.

21 Claims, 3 Drawing Sheets

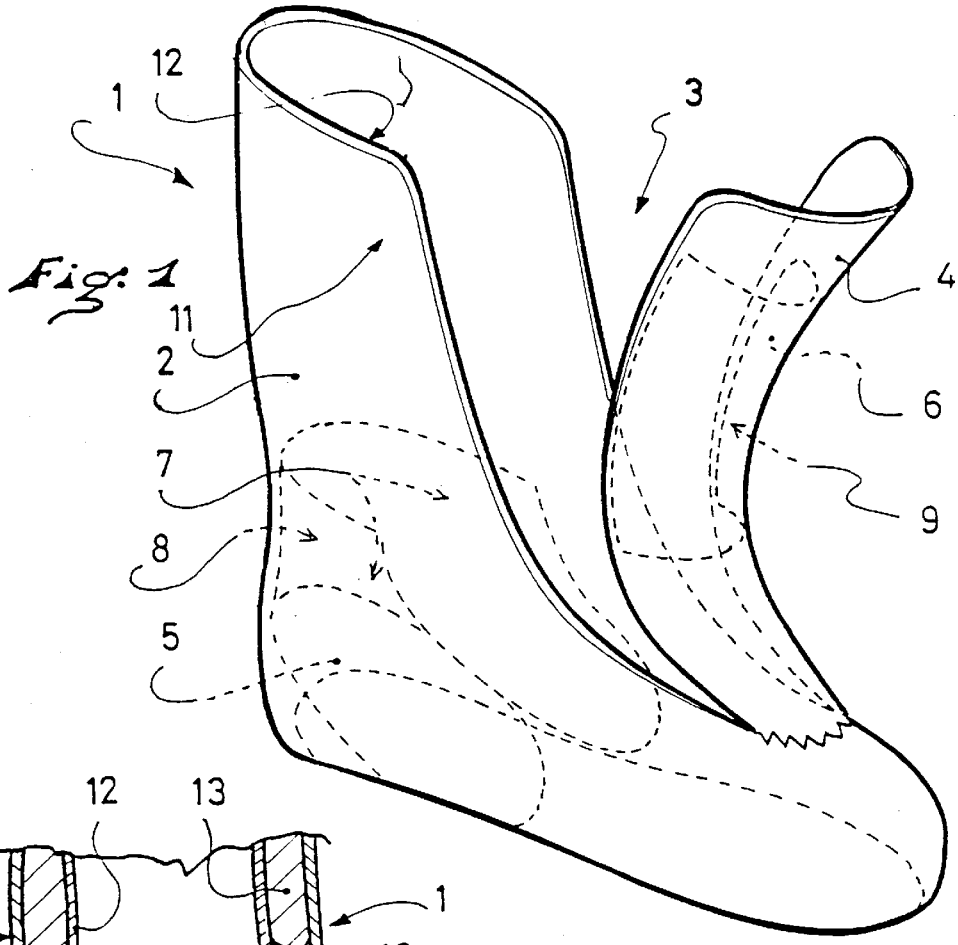
Fig: 1
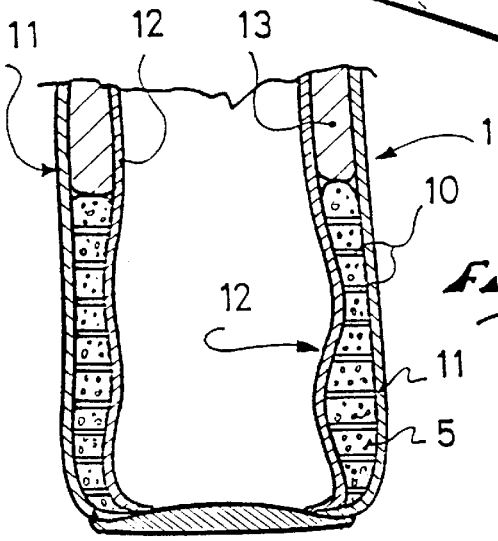
Fig: 2
Fig: 3
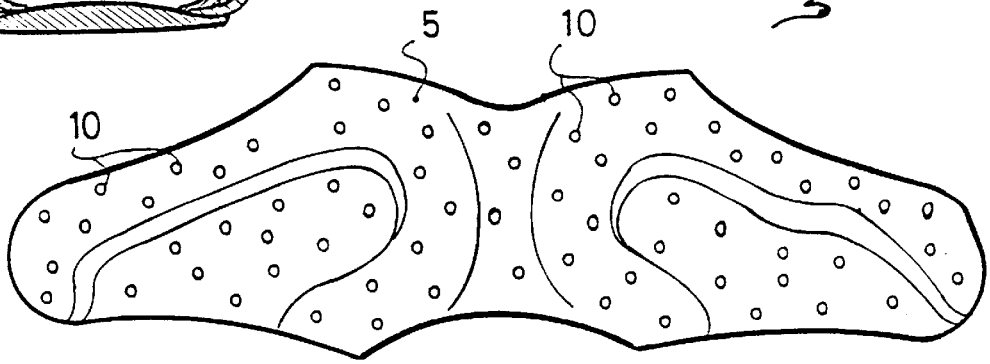

INTERNAL LINER FOR A BOOT

BACKGROUND OF THE INVENTION

1. Field of the Invention

The present invention relates to comfort fittings positioned on the interior of boots, and especially sport boots with a rigid external upper, such as the shells for ski boots or skates, and has as an object the use of a foam wedging element having thermoplastic qualities and adapted to adjust and/or to adapt itself, after it has been heated at its thermoforming temperature, to the specific volume of the user's foot.

2. Description of Background and Relevant Information

In known ski boots comprising internal fittings with this type of thermoplastic foam wedging element, the initial fitting volume, i.e., before adjustment by thermoforming, is, for a given size, either smaller than the standard for this size, or considerably larger, or still not defined. By way of example, such boots are described in the patents EP 004 829, FR 2 460 118, JP 2-270519 and in PCT Application WO 94/09663. As is disclosed, none of the internal liners used in these boots is preformed to a standard fitting volume for a given size, and thus cannot be utilized for skiing until after thermoforming. In effect, in the case of the patent EP 004 829, it is a question of giving room for the foot because the initial cavity is undersized by about one to two sizes with respect to the foot to which one wishes to adapt the boot. The process therefore consists of heating the foam of the wedging element by means of an electric heating element, then, after introduction of the foot of the skier, of compressing said wedging element which is sandwiched between the shell and said foot, and of allowing it to cool in this position.

In the case of the patents FR 2 460 118 and JP 2-270519, it is the opposite operation which is performed. The internal liners are obtained preformed with thermocompressed walls, thus having a relatively high density in this state, and it is by heating them that one causes more or less their relaxation and therefore their adjustment to the foot and within the shell. As this appears clearly, the preforming by thermocompression necessitates providing a cavity, or fitting volume, which is much larger than the volume of the foot to be held because the constituent materials of the walls of the internal fittings having been preliminarily thermocompressed have lost much of their flexibility, and it is impossible to readjust them if desired to a greater volume simply by pressure of the foot.

Such internal liners preformed by thermocompression thus have, for a given size, a considerably greater fitting volume, and their walls in the thermocompressed state have a high density which renders them inappropriate in assuring an acceptable comfort for the foot if they are not heated to relax, and thus in restoring a certain flexibility.

In the example of the internal liner described in PCT Application WO 94/09663, the problem is different from the preceding problems because there, the internal liner is not preformed in its initial state, in fact the fitting volume is not defined; indeed, according to this document, it is essentially due to the integral heating of the liner that it is possible to adapt it on the foot, which, thus equipped, is then introduced in the boot. Therefore, this type of internal liner cannot be, as in the preceding cases, utilized in its initial state for purposes of skiing.

Another disadvantage appears likewise in the internal liners described hereinabove and relates to the stability of the imprints achieved after reheating at the thermoforming temperatures of the materials utilized, such as polyethylene or polyurethane. In effect, these materials which are made in the form of foam are sensitive to repeated pressure and are crushed and collapse with use. Thus, such internal liners must be readjusted to the skier's foot quite often so as to always provide an optimum grip and comfort. So as to limit the number of these readjustment interventions, it is known to vary the density of these foams: a high density providing a high resistance to crushing but a lesser comfort since it is less flexible and less compressible, and conversely, a low density providing a low resistance to crushing but an increased comfort due to the flexibility and substantial compressibility of the foam. The comfort/duration optimum compromise over time is therefore very difficult to achieve.

Furthermore, in the case where the foam is made of polyurethane, a supplemental problem is posed with respect to providing an imprint, because such a foam is not thermoplastic and as a result cannot be put into a specific form or allow for an adjustment on the foot of the skier simply by means of a heat source. To overcome this disadvantage, it is proposed in the patent JP 2-270519 to mix the polyurethane in the form which is given to it, such as the imprint of the foot. The addition of the resin thus confers to the polyurethane foam properties and behavior similar to those of a thermoplastic foam.

During a readjustment to a new foot imprint, it then suffices to reheat the foam charged with resin until the latter becomes plastic to allow the polyurethane to relax and/or to compress itself depending on the form imposed by this new imprint, and to let it cool. This type of internal liner with a polyurethane wedging element loaded with resin proves however relatively uncomfortable because the flexibility and initial compressibility of the polyurethane foam are almost eliminated by the resin which, in fact, is the element which gives the consistency of the foam thus obtained.

This type of problem is not posed with foams made of thermoplastic materials such as polyethylene, ethylene vinyl acetate polymer, and polypropylene for example, because their thermoplastic nature does not require the addition of a resin. However, other disadvantages occur because of their very thermoplastic nature. One concerns their flexibility and compressibility which are relatively inferior than those of polyurethane, which detracts from comfort; and the other, their sealed structure which does not permit a good diffusion of heat throughout their mass during the heating operation to bring them to the temperature which renders them plastic, and therefore thermoformable.

SUMMARY OF THE INVENTION

The present invention aims at overcoming these various disadvantages of known internal liners made of thermoplastic foam, and proposes a preformed internal fitting having a standard initial liner volume for a given size and capable of being utilized as such to hold the foot in the boot, by assuring a comfort and a holding which are analogous to those of a conventional internal liner, and capable of being specifically adapted to the form of at least one part of the foot by reheating at a given temperature and then cooling.

To achieve this goal, the comfort internal liner for boots according to the invention is obtained preformed at a standard initial fitting volume for a given size, and comprises at least one wedging element made out of foam of a thermoplastic nature which is preformed by thermocompression. The wedging element made of thermoplastic foam is microperforated to:

improve its elastic compressibility and flexibility, thus its comfort, even in the preformed state despite its high density (>50 $Kg/m^3$), provide it with a certain permeability allowing in particular the evacuation of the sweat relative to the foot, allow for a good and rapid diffusion of the heat throughout its mass during the heating operation so as to assume the imprint because the micro-perforations extend through it.

According to a preferred embodiment of the invention, the thermoplastic foam is a polyethylene foam, of ethylene vinyl acetate polymer, or of polypropylene, for example, but can of course be the result of the combination of a plurality of thermoplastic materials.

According to one embodiment, the wedging element is interposed between an exterior flexible or semiflexible wall of the internal liner and a comfort fabric constituting the interior wall of the latter, and the form of the imprint which is given to it by thermocompression is such that the fitting volume at the level of this wedging element corresponds to the standard fitting volume of the given size being considered.

Thus, for a "standard" foot, it is not necessary to resort to a particular adaptation of the internal fitting which can be utilized as such; in effect, despite the fact that the wedging element is thermocompressed, and therefore that it has a high density in this state, the micro-perforations procure for it a sufficient flexibility so as to be able to be retightened on the foot by traditional closure and tightening means of the boot in the same way as a conventional liner. On the contrary, in the case where the skier desires a more precise adaptation to his foot or at least to a portion thereof, it suffices to reactivate by heating only the concerned zone of the wedging element and to then tighten the said element on the foot by means of closure and tightening means of the shell. The wedging element being sandwiched between the interior comfort fabric and the exterior wall of the liner which is generally flexible but non-extendible, the imprint occurs mostly on the side the user's foot.

According to another embodiment, the wedging element is not included or interposed in the wall of the internal liner but is attached, in the manner of an element conceived independently, on the wall of the said liner, to the exterior and/or interior of the latter.

BRIEF DESCRIPTION OF THE DRAWINGS

The present invention will be better understood with reference to the description which follows referring to the annexed schematic drawings giving, by way of example, several embodiments of the liner.

FIG. 1 illustrates, in a perspective view, an internal liner in the form of a front opening liner having an upper and a tongue provided with thermocompressed wedging elements preformed and micro-perforated according to the invention;

FIG. 2 is a partial cross sectional view along II—II of the liner of FIG. 1;

FIG. 3 shows, in a flat view, the wedging element which is inserted in the upper of the liner of FIG. 1;

FIG. 7, on the interior of the liner.

DETAILED DESCRIPTION OF THE INVENTION

Figure 4:
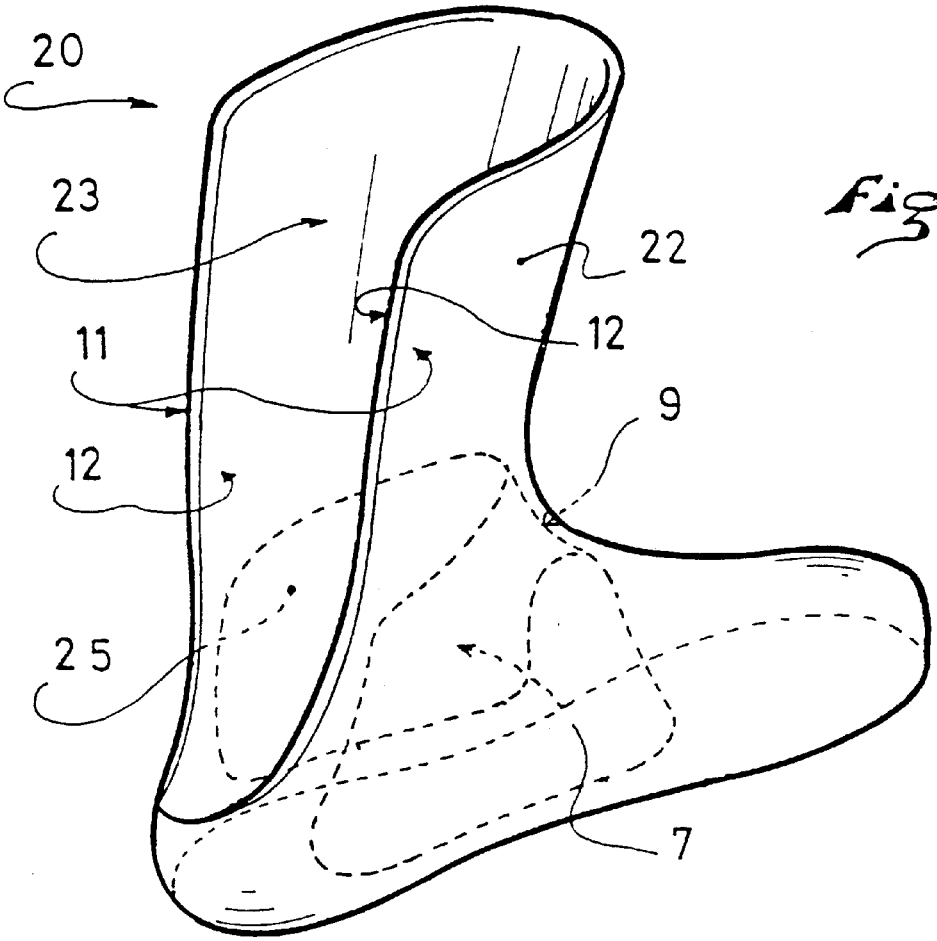
FIG. 4 shows an upper of an internal liner in the form of a rear opening liner provided with a wedging element in the zone extending from the instep/flexion fold to the malleoli.

The internal fitting in the form of liner 1, illustrated in FIG. 1, has an upper 2 with a front opening 3 and a tongue 4 adapted to close said opening 3 back in the position of tightening and holding the user's foot.

This liner 1 is preformed at an initial standard fitting volume for a given size and is provided, in this example of construction, with two wedging elements 5 and 6 which are provided in the form of a foam from a thermoplastic material, the element 5 being arranged on the zone corresponding to the malleoli 7 and to the heel 8, and the element 6 on the zone corresponding to the instep/flexion fold 9 of the user. These elements are preformed by thermocompression and have an initial imprint of a shape substantially corresponding to that of the zone of the foot which they cover.

These elements which are preformed by thermocompression are adaptable and adjustable specifically to the shape of a "non-standard" foot simply by reheating up to the temperature which renders them plastic, which allows for their relaxation to a volume close to that which they had before thermocompression. The user's foot is then introduced by force in the liner, i.e., it recompresses at least partially the wedging elements, which thus assume exactly the form of its imprint. The liner being maintained on the foot within the boot in the tightening position until cooling of the wedging elements 5 and 6, the latter are stabilized by maintaining the imprint imposed by the foot.

According to the invention, these elements 5 and 6, which are most often made out of polyethylene, ethylene vinyl acetate co-polymer or of polypropylene, and thus sealed, are micro-perforated in their thickness. These micro-perforations 10, shown in FIGS. 2 and 3, render them more flexible and improve their compressibility even in the thermocompressed state. Likewise, they acquire a certain permeability improving substantially the comfort and hygiene of the foot due to the possible evacuation of sweat. Furthermore, these micro-perforations allow for a more rapid and in-depth diffusion of the heat when one proceeds to reheat the elements for assuming an imprint. This advantage is not negligible because it is thus possible to operate with heat sources which are weaker and thus less capable of damaging or destroying the surface "skin" of the elements 5 and 6 which is exposed to the heat sources.

In this embodiment of liner 1, the elements 5 and 6 are interposed between its exterior wall 11 and interior wall 12, and cooperate with the other padding and comfort elements of the liner which are placed at their periphery such as that of 13, which can be made out of a merely compressible foam. It is self-evident that the ordinary padding elements can likewise be arranged on one and/or the other lateral surfaces of the wedging elements 5 and 6 made of micro-perforated thermoplastic foam.

In the example of FIG. 4, the liner 20 has an upper 22 formed with a rear opening 23 and a wedging element 25 which substantially covers the zones corresponding to the malleoli 7 and to the instep/flexion fold 9. As described previously, the wedging element 25 is wedged between the exterior wall 11 and interior wall 12 of the liner.

Figure 5:
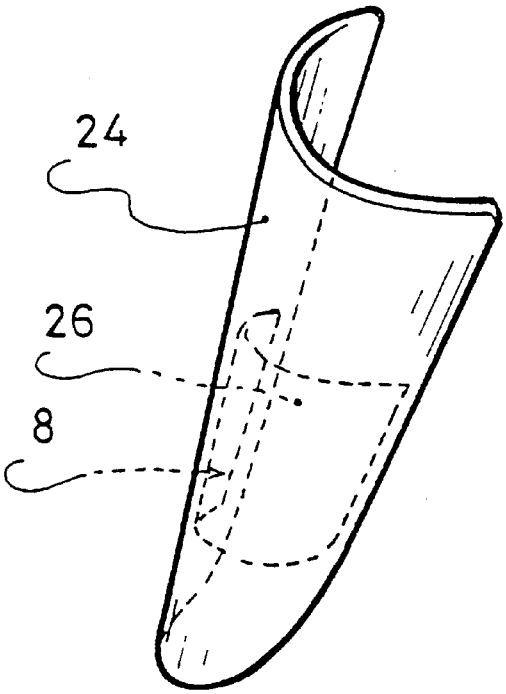
FIG. 5 schematically illustrates the rear comfort wedge of the rear opening liner of FIG. 4, which wedge is provided with a wedging element in the zone corresponding substantially to that of the heel.

This type of liner 20, having a rear opening 23, normally equips the shells of ski boots known as "rear entry" boots; a rear wedge 24, such as illustrated in FIG. 5, is then affixed on the rear portion of the upper of the shell of these boots (not shown) and is adapted to close the liner 20 on the foot of the skier. Of course, such a wedge 24 can be equipped, for example in the zone of the heel 8, with a wedging element 26 made out of preformed and micro-perforated thermoplastic foam according to the invention.

Figure 6:
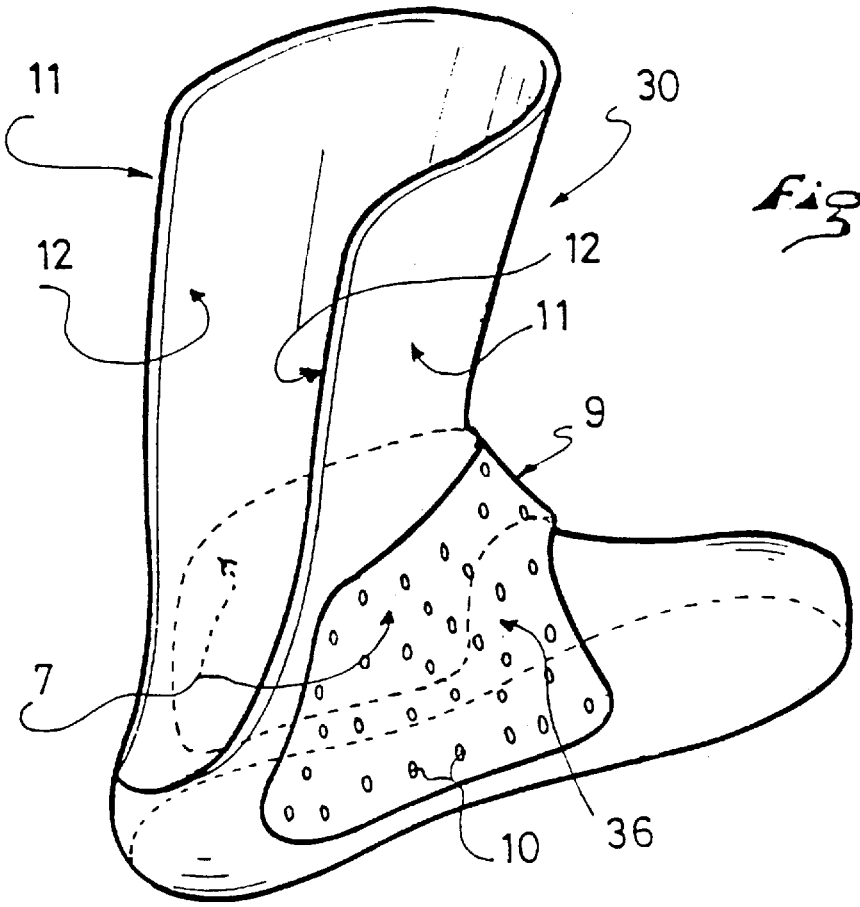
FIGS. 6 and 7 illustrate internal liners in the form of liners provided with a wedging element according to the invention which is positioned, FIG. 6, on the exterior of the liner.
Figure 7:
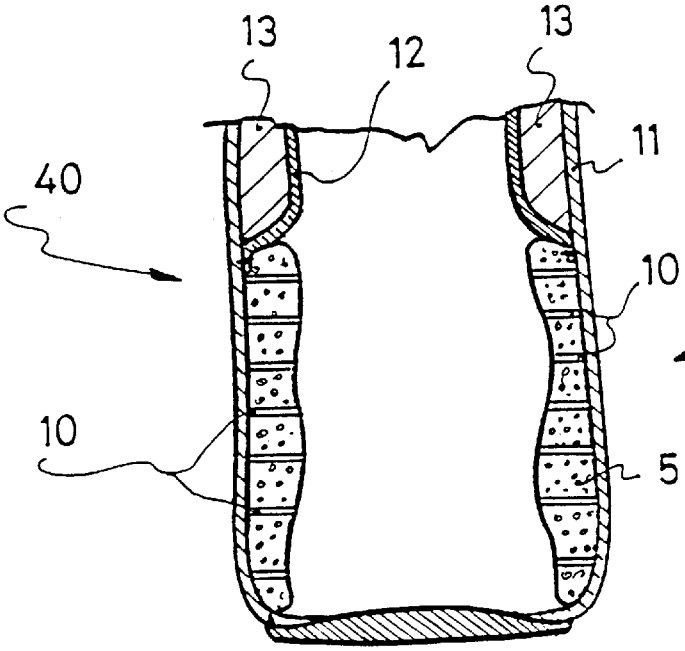

Likewise, such as shown in FIGS. 6 and 7, the wedging elements made of preformed and micro-perforated thermoplastic foam can be designed as independent and/or additional elements to a comfort liner. Thus, in the example of FIG. 6, the wedging element 36 made out of preformed and micro-perforated thermoplastic foam 10 is adapted on the external wall 11 of the liner 30, and extends substantially on the zone corresponding to the malleoli 7 and to the instep/flexion fold 9.

Furthermore, as shown in FIG. 7, a liner 40 can have one or more ordinary padding elements 13 in the less sensitive zones of the foot, and a reserved location adapted to receive a preformed and micro-perforated thermoplastic wedging element 5 designed independently. By means of this construction, the wedging element is adapted to be positioned immediately adjacent to the foot inserted into the liner.

Thus, this wedging element can be positioned at the last moment in the liner, for example during taking of the imprint of the foot, after reheating outside of the liner.

It is evident that the invention is not limited to a partial wedging element of an internal liner. Thus, for example, the preformed and micro-perforated thermoplastic wedging element can constitute the internal liner itself or extend over its entire surface.

Furthermore, the invention applies to both the removable internal liners such as those used in ski or skate boots, and fixed fittings such as used in boots for sports such as tennis, basketball, or normal boots, whether these boots have a more or less rigid flexible upper.

We claim:

1. A liner for a boot, said liner comprising:

at least one wedging element;

said wedging element consisting of a thermoplastic foam; and said wedging element having micro-perforations for increasing flexibility and elasticity of said wedging element, for rendering said wedging element permeable for evacuation of sweat, and for allowing for good and rapid diffusion of heat;

said micro-perforations being through-holes, extending through a thickness of said liner, from a first to a second surface of said liner.

2. A boot comprising:

a liner adapted to be received within a boot, said liner comprising:

at least one wedging element;

said wedging element made of a thermoplastic foam, said thermoplastic foam material of said wedging element has a density greater than 50 $Kg/m^3$; and said wedging element having micro-perforations for increasing flexibility and elasticity of said wedging element, for rendering said wedging element permeable for evacuation of sweat, and for allowing for good and rapid diffusion of heat.

3. A boot comprising:

a liner adapted to be received within a boot, said liner comprising:

at least one wedging element;

said wedging element made of a thermoplastic foam; and said wedging element having micro-perforations for increasing flexibility and elasticity of said wedging element, for rendering said wedging element permeable for evacuation of sweat, and for allowing for good and rapid diffusion of heat;

said micro-perforations being through-holes, extending from a first to a second surface of said liner.

4. A liner for a boot, said liner comprising:

at least one wedging element;

said wedging element consisting of a thermoplastic foam;

said wedging element having micro-perforations for increasing flexibility and elasticity of said wedging element, for rendering said wedging element permeable, and for allowing for good and rapid diffusion of heat; and said liner having a shape preformed by thermocompression of said wedging element to have an initial standard internal fitting volume corresponding to a respective boot size.

5. A boot comprising:

a liner adapted to be received within a boot, said comfort liner comprising:

at least one wedging element;

said wedging element consisting of a thermoplastic foam;

said wedging element having micro-perforations for increasing flexibility and elasticity of said wedging element, for rendering said wedging element permeable, and for allowing for good and rapid diffusion of heat; and said liner having a shape preformed by thermocompression of said wedging element to have an initial standard internal fitting volume corresponding to a respective boot size.

6. A liner for a boot, said liner comprising:

at least one wedging element;

said wedging element consisting of a thermoplastic foam, said thermoplastic foam material of said wedging element has a density greater than 50 $Kg/m^3$; and said wedging element having micro-perforations for increasing flexibility and elasticity of said wedging element, for rendering said wedging element permeable for evacuation of sweat, and for allowing for good and rapid diffusion of heat.

7. A liner according to claim 6, further comprising:

an interior wall and an exterior wall; and said wedging element is interposed between said interior wall and said exterior wall of said liner.

8. A liner according to claim 6, further comprising:

an exterior wall having an outer surface; and said wedging element is an independent element attached to said outer surface of said exterior wall.

9. A liner according to claim 6, further comprising:

an inner surface; and said wedging element is an independent element attached to said inner surface of said liner adapted to be exposed to a foot inserted into said liner.

10. A liner according to claim 6, further comprising:

an interior wall and an exterior wall; and said wedging element is affixed to one of said interior and exterior walls and extends over only a portion of said one of said interior and exterior walls.

11. A liner according to claim 6, further comprising:

an interior wall and an exterior wall;

said wedging element is affixed to predetermined portions of one of said interior and exterior walls, said predetermined portions constituting less than an entirety of said interior and exterior walls; and said predetermined portions of one of said interior and exterior walls comprises a malleoli portion and a heel portion.

12. A liner according to claim 6, further comprising:

an interior wall and an exterior wall;

said wedging element is affixed to predetermined portions of one of said interior and exterior walls, said predetermined portions constituting less than an entirety of said interior and exterior walls; and said predetermined portions of one of said interior and exterior walls comprises a malleoli portion and a flexion fold portion.

13. A liner according to claim 6, further comprising:

an interior wall and an exterior wall;

said wedging element is affixed to a predetermined portion of one of said interior and exterior walls, said predetermined portion constituting less than an entirety of said interior and exterior walls; and said predetermined portion of one of said interior and exterior walls comprises a flexion fold portion.

14. A liner according to claim 6, further comprising:

an interior wall and an exterior wall;

said wedging element is affixed to a predetermined portion of one of said interior and exterior walls, said predetermined portion constituting less than an entirety of said interior and exterior walls; and said predetermined portion of one of said interior and exterior walls comprises a heel portion.

15. A liner according to claim 6, wherein:

a housing is provided for each of said at least one wedging element.

16. A liner according to claim 6, wherein:

the entirety of the boot liner is made of said thermoplastic foam.

17. A liner according to claim 6, wherein:

said thermoplastic foam comprises a member selected from the group consisting of polyethylene, ethylene vinyl acetate co-polymer, and polypropylene.

18. A boot according to claim 6, wherein:

said shape is preformed by thermocompression.

19. A liner according to claim 6, wherein:

said thermoplastic foam material comprises a homogeneous material.

20. A boot according to claim 2, wherein:

said shape of said liner is preformed by thermocompression.

21. A boot according to claim 2, wherein:

said thermoplastic foam material comprises a homogeneous material.

* * * * *